United States Patent [19]

Yoshida

[11] 3,956,839

[45] May 18, 1976

[54] FRAME AND A DEVICE FOR SECURING DISPLAY PANELS IN SAID FRAME

[76] Inventor: Tsukasa Yoshida, Nikko Danchi 15-202 Nikko-cho No. 1-3, Fucheu, Tokyo, Japan

[22] Filed: Feb. 28, 1975

[21] Appl. No.: 554,043

Related U.S. Application Data

[63] Continuation of Ser. No. 392,122, Aug. 27, 1973, abandoned.

[30] Foreign Application Priority Data

Aug. 31, 1972 Japan ..... 47-100975

[52] U.S. Cl. ..... 40/156

[51] Int. Cl.[2] ..... G09F 1/12

[58] Field of Search ..... 40/152, 156, 155; 52/497, 498, 499, 500, 501, 502

[56] References Cited

UNITED STATES PATENTS

| | | | |
|---|---|---|---|
| 1,964,557 | 6/1934 | Brezinski | 52/499 |
| 2,612,244 | 9/1952 | Kiefer | 52/498 |
| 2,716,784 | 9/1955 | Kuyper | 52/499 |
| 2,970,397 | 2/1961 | Roseman | 40/156 |
| 3,023,525 | 3/1962 | Cointreau | 40/155 |
| 3,736,684 | 6/1973 | Grad | 40/152 |

FOREIGN PATENTS OR APPLICATIONS

| | | | |
|---|---|---|---|
| 94,208 | 5/1959 | Norway | 52/500 |

*Primary Examiner*—Louis G. Mancene
*Assistant Examiner*—Wenceslao J. Contreras
*Attorney, Agent, or Firm*—Sughrue, Rothwell, Mion, Zinn & Macpeak

[57] ABSTRACT

A frame is comprised of a plurality of channel-shaped members each having an inwardly extending flange for supporting a display panel. A L-shaped member is inserted in each channel with one leg thereof extending inwardly in parallel spaced relation to the flange for gripping a display panel therebetween. The other leg of the L-shaped member and one wall of the channel are provided with corregations and a plug is inserted into the channel to dispose the corregation in interfitting relation thereby securing the L-shaped member to the channel-shaped member. The plug is provided with a hole and a wedge is forced into the hole to expand the plug into tight frictional engagement with the channel and the L-shaped member.

2 Claims, 7 Drawing Figures

FRAME AND A DEVICE FOR SECURING DISPLAY PANELS IN SAID FRAME

This is a continuation of application Ser. No. 392,122, filed Aug. 27, 1973, abandoned.

DESCRIPTION OF THE PRIOR ART

In the conventional method for setting display panels in a frame for use in displaying panels such as pictures, photos or posters, setting of panels has been made by means of screws or nails. That method, however, results in such disadvantages that, when replacement of a panel in comparatively short time is required, damages on panels, due to the loose screws or nails, are so frequent at the time of replacement. Accordingly, either attachment or replacement of panels is troublesome and takes much time.

SUMMARY OF THE INVENTION

A prime object of the present invention is to provide a device for fixedly setting pictures, photos or posters in a frame, in which setting of panels in a frame is effected by means of a channel-shaped material for frame made of a hard synthetic resin or a metallic material such as aluminium or the like, a plug made of a resilient synthetic resin or rubber, and a wedge made of a hard material such as aluminium or the like; rather than by means of screws or nails, and therefore, there is no necessity for a tool.

Another object of the present invention is to provide a solid framing of display panels, which can be performed by such a simple work that a plug is inserted into the recess formed on the channel shaped material for frame and a wedge is driven into a hole of said plug, thereby firmly securing panels.

A further object of the present invention is to provide a device for fixedly setting display panels in a frame, wherein, when replacement of a panel is required, replacement is easily workable, just by disjointing the channel shaped material for frame by pulling out a wedge from a plug and further by pulling out a plug from a recess formed by the combination of said channel shaped material for frame.

A still further object of the present invention is to provide a device, which is capable of changing the ornamental pattern on the surface of said channel shaped material for frame through various combination of said material with ease.

A still further object of the present invention is to provide a device, in which the device is applicable for setting any type of panels made of any kind of material and having any thickness; and good results can be obtained from the aesthetic point of view.

DETAILED DESCRIPTION OF THE INVENTION

Figure 1:
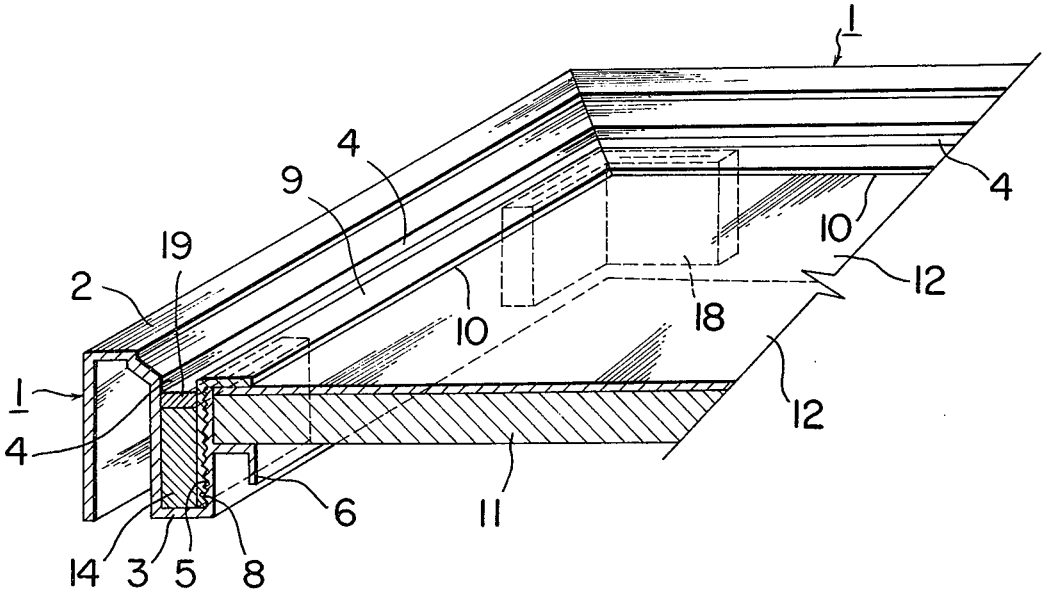
FIG. 1 is a perspective view showing an embodiment of the present invention.

A device for fixedly setting display panels in a frame consists of a plurality of channel-shaped members defining a frame 1, a holder member 10, a plug 14, 18 which a wedge 15.

The channel shaped member for frame 1 shown in the drawing is made of a hard synthetic resin or metal such as aluminium or the like, and on the surface of said material is formed an appropriate ornament 2, said ornamental portion extends laterally to form a U-shaped projection 3 which forms a recess 4, which opens to the surface and is parallel to the long line direction. An inside wall of the recess 4 is provided with wave-like indents 5 and a side wall is bent at a right angle to extend outwardly to form a L-shaped projection 6. On the outer side, the other wall of the ornamental surface 2 extends downwardly to form a bent portion.

A holder member 10 is made of a hard synthetic resin or a metallic material such as aluminium or the like having a L-shaped cross section and consisting of an appropriately ornamented surface 9 and a head portion provided with a wave-like indents 8.

Figure 2:
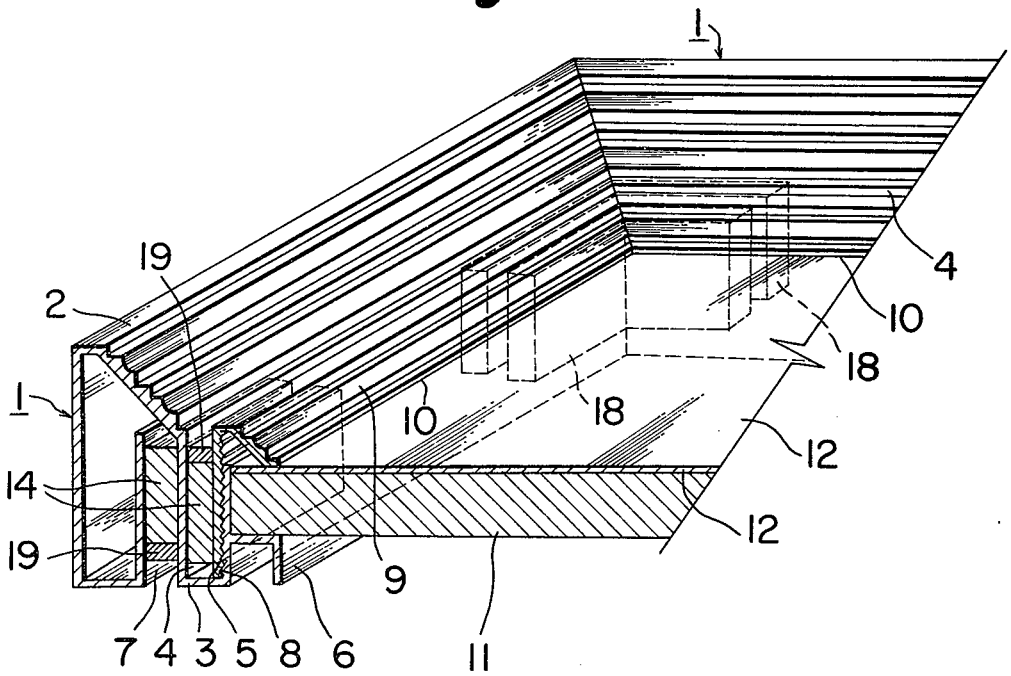
FIG. 2 is a perspective view showing other embodiment of the present invention.

FIG. 2 shows the device in another embodiment, in which the material for frame 1 is illustrated. This material for frame 1 consists of a vertical wall extending from the side of the ornamental surface 2, and forms two right angles so as to form a upright portion making a U-shaped bent projection. Thus, between this upright portion and the side wall of said recess 4 is formed another recess 7.

Figure 3:
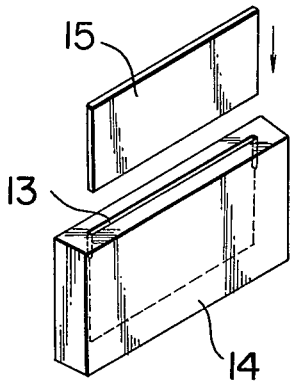
FIG. 3 is a perspective view of a plug and wedge.
Figure 4:
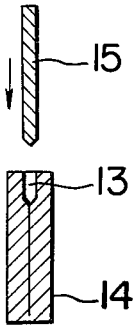
FIG. 4 is a longitudinal sectional view of the plug.

FIGS. 3 and 4 show a plug 14 and a wedge 15, in which said plug 14 is made of a resilient synthetic resin or rubber, and provided at its upper head portion from the upper to the lower portion, at a right angle with a hole 13.

And a wedge 15 are mainly made of a thin metal, and is driven into the hole 13 of said plug 14. The size of said wedge substantially conforms to the size of the hole 13.

Figure 5:
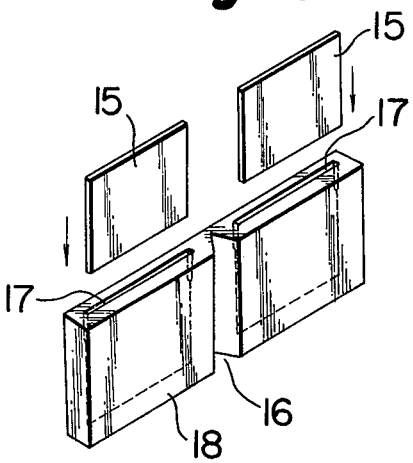
FIG. 5 is a perspective view showing a plug and a wedge which are to be used in the corner.
Figure 6:
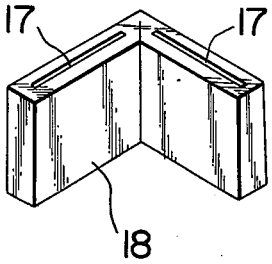
FIG. 6 is a perspective view showing a plug bent which is used in the corner.

FIG. 5 shows a plug 18 that is to be inserted into the corner portion of the frame. This plug 18, in its central part, forms a notch 16 so as to be bent inwardly as shown in FIG. 6.

Figure 7:
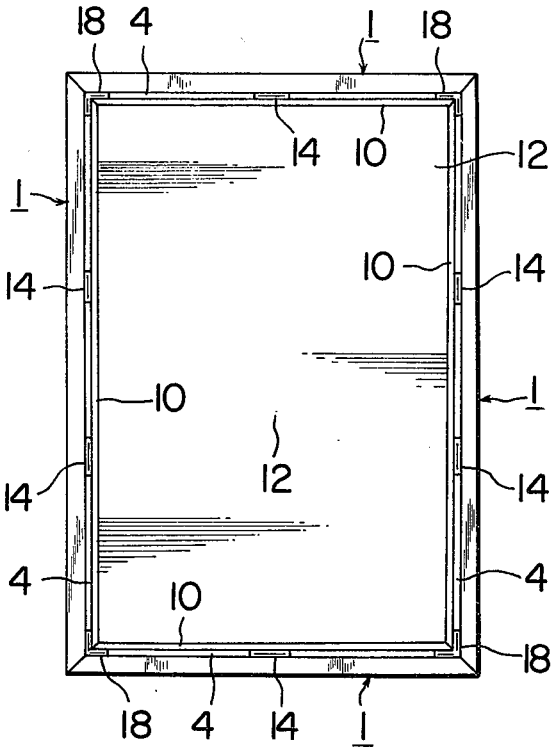
FIG. 7 is a plane view showing an embodiment of the present invention.

FIG. 1, FIG. 2 and FIG. 7 show the device in the embodiment. In fixing, first a back panel 11 is attached on the upper part of the counter L-shaped portion 6 formed on the shaped material for frame, and then on the back panel 11 is attached a display panel 12 such as pictures. And on the display panel 12 is put the holder member 10 at the portion of ornamental surface 9, thereby jamming the display panel 12 and the said back panel 11 between this holder member 10 and the said counter L-shaped material, and the wave-like indent 8 is set to the wave-like indent 5 of the shaped material for frame.

Thereafter, the plug 14 is put into the appropriate part of the recess 4, then the plug 18, being bent in the center, is put to the corner. Succeedingly, the wedges 15 are inserted into the holes 13 and 17, the plug 14 and 18 extending to the horizontal direction and pressing on the frank side of the recess 4, thereby each member of the device being firmly assembled, the display panel 12 and the back panel 11 are firmly secured. Thereafter, a filler strip 19 may be inserted in recess 4 to cover the plugs 14 and 18.

In another embodiment illustrated in FIG. 2, the device for a frame that can set plugs not only on the front but also on the back side is shown, in which a recess 4 and a recess 7 are provided on the front and on the back side of the frame, and therein are inserted plugs 14 and 18.

The disassembling can be done in the opposite way of assembling, first, pulling out the wedge 15, the plug is pulled out from the recess 4 and 7. Then, taking off the holding member 10 from the shaped material for frame 1, and the change of the display of panels is easily executed.

What we claim is:

1. A frame for holding display panels is comprised of a plurality of channel-shaped frame members each having front and rear surfaces and an elongated recess in said front surface thereof and an inwardly extending flange for supporting a display panel thereon, a plurality of L-shaped display panel holder members coextensive in length with said recess each having one leg thereof disposed in a respective recess with the other leg thereof extending inwardly in spaced apart overlying relation with respect to said flange to hold and cover the entire peripheral edge of a display panel on said flange, said one leg of said holder member and the opposed wall of said recess having complementary regularly spaced wave-like indentations extending the length of said recess and separate, expandable and removable plug means disposed in each of said recesses to secure said holder members in adjusted locked relation due to inter-engagement of said wave-like portions.

2. A frame as set forth in claim 1 wherein said expandable plug means is comprised of a block of resilient material having an aperture therein and wedge means adapted to be removably inserted into said aperture to expand said plug means into tight fitting engagement with said recess and said one leg of said holder member.

* * * * *